United States Patent [19]

Hellquist et al.

[11] Patent Number: 4,926,855

[45] Date of Patent: May 22, 1990

[54] RESPIRATOR

[75] Inventors: Ivan Hellquist, Sollentuna; Carl P. M. Mühlmann, Lidingo, both of Sweden

[73] Assignee: Interspiro AB, Lidingo, Sweden

[21] Appl. No.: 8,195

[22] Filed: Jan. 29, 1987

Related U.S. Application Data

[63] Continuation-in-part of Ser. No. 774,625, Sep. 11, 1985.

[30] Foreign Application Priority Data

Sep. 21, 1984 [SE] Sweden ..... 8404752

[51] Int. Cl.[5] ..... A62B 18/10

[52] U.S. Cl. ..... 128/201.28; 128/205.13; 128/205.17; 128/206.15; 128/209.12

[58] Field of Search ..... 128/261.15, 201.73, 128/201.25, 201.26, 201.28, 201.29, 202.11, 203.28, 205.12, 205.13, 205.17, 205.25, 205.26, 205.27, 206.21, 206.24, 206.28, 207.12, 204.26, 204.28

[56] References Cited

U.S. PATENT DOCUMENTS

| | | | |
|---|---|---|---|
| 2,800,901 | 7/1957 | Monro | 128/201.29 |
| 2,871,854 | 2/1959 | Lambertsen | 128/205.17 |
| 3,366,108 | 1/1968 | Blackburn et al. . | |
| 3,565,068 | 2/1971 | Bickford . | |
| 3,604,416 | 9/1971 | Petrahai . . | |
| 3,913,576 | 10/1975 | Martin et al. | 128/204.28 |
| 3,976,063 | 8/1976 | Henneman et al. . | |
| 4,294,243 | 10/1981 | Ernsting et al. . | |
| 4,299,216 | 10/1981 | Bernard et al. | 128/205.12 |
| 4,649,912 | 3/1987 | Collins | 128/205.17 |

FOREIGN PATENT DOCUMENTS

| | | | |
|---|---|---|---|
| 104765 | 10/1897 | Fed. Rep. of Germany . | |
| 1958720 | 5/1971 | Fed. Rep. of Germany . | |
| 2544205 | 11/1982 | France . | |
| 248356 | 9/1926 | United Kingdom . | |
| 1317172 | 5/1973 | United Kingdom . | |
| 1462361 | 1/1977 | United Kingdom . | |
| 1587121 | 4/1981 | United Kingdom . | |
| 2074456 | 11/1981 | United Kingdom . | |
| 2164570 | 3/1986 | United Kingdom | 128/201.25 |

*Primary Examiner*—Max Hindenburg
*Assistant Examiner*—K. M. Reichle
*Attorney, Agent, or Firm*—Pollock, Vande Sande & Priddy

[57] ABSTRACT

A rescue type breathing apparatus which includes a hood and a face mask incorporated inside the hood. During a first phase of the inhalation cycle a breathing gas is supplied to the face mask from the gas container through a bladder. After the bladder has been emptied breathing gas in a second phase of the inhalation cycle is supplied from the hood and the gas container.

19 Claims, 5 Drawing Sheets

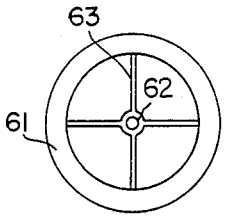
FIG.3A
FIG.3B
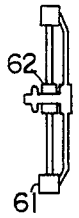
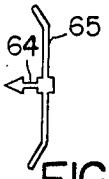
FIG.3C
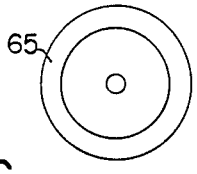
FIG.3D
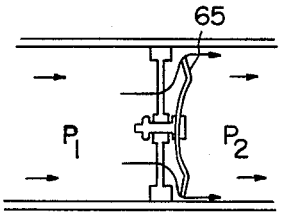
FIG.4A
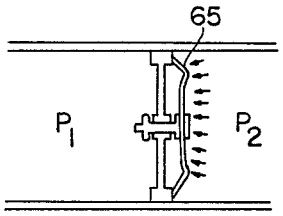
FIG.4B
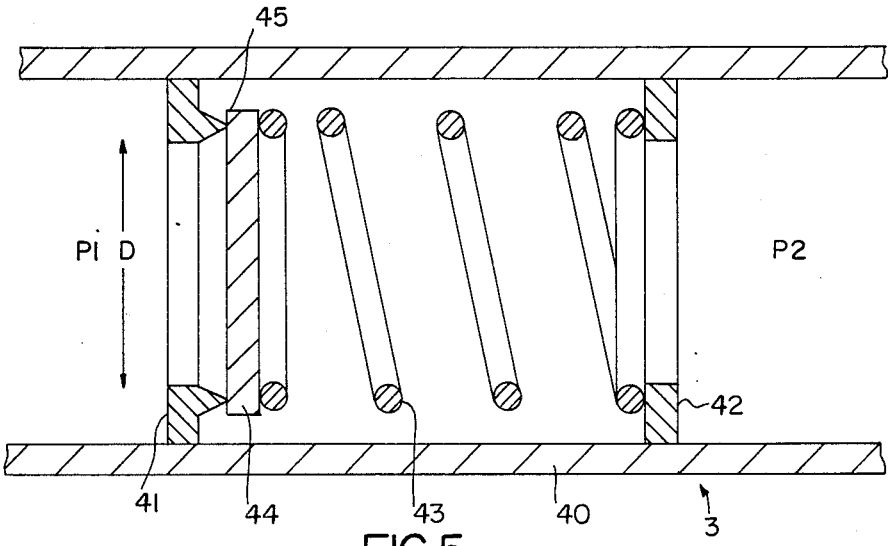
FIG.5

RESPIRATOR

This is a continuation-in-part of copending application Ser. No. 774,625 filed on Sept. 11, 1985.

BACKGROUND OF THE INVENTION

The present invention relates to a rescue type respirator comprising a hood which is intended for application over the user's head, a container of breathing gas, means for connecting the hood and the container and controlling means disposed between the container and the hood for controlling the flow of the breathing gas.

Respirators of this kind which are already known in the art and comprise a breathing mask which through hoses, communicates partially with a gas container and partially with an absorbing filter for absorption of carbon dioxide. The breathing gas circulates in a circuit through the filter and the mask. A small flow of breathing gas is supplied to the mask from the container in order to keep the oxygen content at an acceptable level.

The problem with this type of respirator resides in provision of a satisfactory seal between the mask and the face of the user. Consequently, there is a considerable risk that harmful gases from the surrounding area will leak into the mask.

The use of a hood which is applied over the user's head and to which breathing gas is conducted from a container is also known in the art. In order to prevent the carbon dioxide content from becoming excessively high, in a mask of this type, it is essential to maintain a relatively powerful flow of gas which requires a large gas container if the usage time is to be of any considerable length. It is in fact desirable for the apparatus to be capable of continuous operation for approximately 15 minutes.

SUMMARY OF THE INVENTION

The object of the present invention is to provide a rescue type respirator in which the above disadvantages have been eliminated. This has been attained by means of a respirator which is provided with a hood incorporating a face mask.

According to the present invention a face mask located in the hood provides a sealing means preventing the irrespirable gas from reaching the noses and mouths of users in addition to a sealing barrier which is created by the hood tightly surrounding the wearer's neck and preventing gas leakage from the outside. The novel structure of the present invention respirator incorporating a mask and a hood within a respiratory circuit also allows supplying of a first fresh breathing gas to the wearer's lungs during the first part of the inhalation phase and a mixture of the fresh breathing gas and a portion of the previously exhaled gas from the hood during a second part of the inhalation phase. Such a structure and method are advantageous. They allow expanded usage of a given amount of breathing gas from a breathing gas container as compared to the known respirators and methods. In one embodiment means are provided for discontinuing the flow of the breathing gas from the container and supplying the gas only from the hood during the second part of the inhalation phase. The method and apparatus of this embodiment allow further extension of the length of respirator operation time using a comparable gas container with equivalent capacity to those used in the same type respirators of the prior art. At the same time since the gas from the hood is supplied only during a second part of the inhalation phase it remains in the mask wearer's lungs for a shorter amount of time than the fresh breathing gas and allows maintenance of acceptable carbon dioxide/oxygen levels within the apparatus.

BRIEF DESCRIPTION OF THE DRAWINGS

The invention will now be described in greater detail with reference to the accompanying drawings, in which:

FIG. 3 shows one embodiment of valves 4 and 6 used in the apparatus of FIG. 1 wherein A is a front view of a valve seat, B is a cross-section of the valve, C is a cross-section of the valve body; and D is a front view of the valve body;

FIG. 4 A & B show operation of valves 4 and 6;

FIG. 5 shows one embodiment of valve 3 used in the apparatus of the present invention;

DESCRIPTION OF THE PREFERRED EMBODIMENTS

Figure 1:
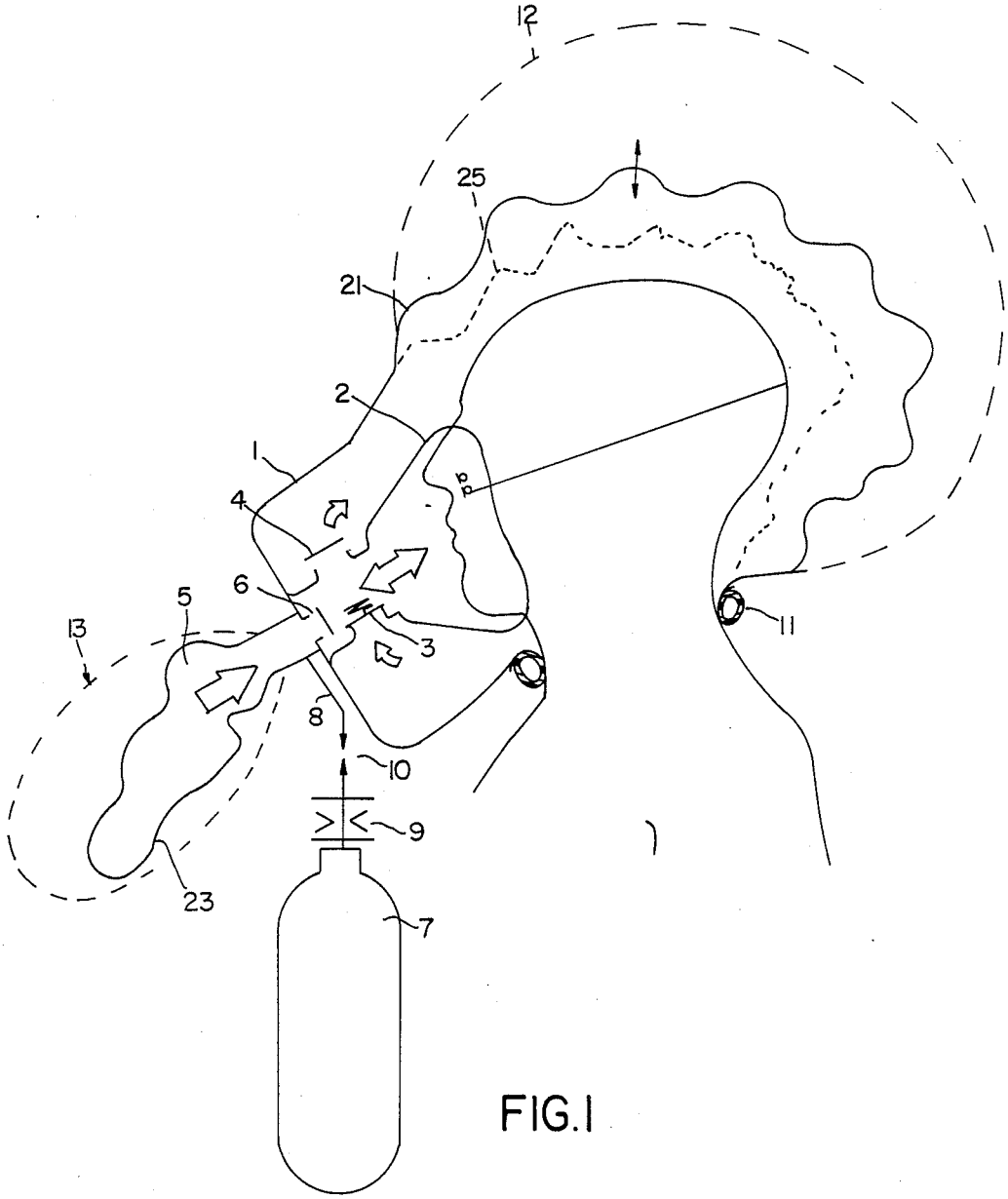
FIG. 1 shows a schematic cross-section of one embodiment of the apparatus according to the present invention.

The respirator shown in FIG. 1 comprises a hood 1 with a gas capacity of approximately 6 liters. The hood 1 is applied over the user's head. The major part of hood 1 is made of a plastic, flexible, but not necessarily resilient material. This material is preferably fire resistant such as woven polyamide coated with plastic or rubber. The hood is provided with a window (not shown). Hood 1 comprises a neckband 11 which resiliently and tightly surrounds a wearer's neck and preferably allows gas from the inside of hood 1 to escape to the outside if the pressure in the hood exceeds the pressure of the surrounding area but will essentially prevent leakage to the inside of hood 1 if the outside pressure exceeds the inside pressure. In case of lower pressure on the inside than on the outside of hood 1 it will reshape to decrease its volume.

Mounted in hood 1 is face mask 2 which is provided with an inhalation valve 3 and an exhalation valve 4. An external breathing bladder 5 or flexible reservoir is connected to the face mask 2 through a check valve 6. A breathing gas container 7 communicates through line 8 with a shut off valve 9 and through flow control valve 10 with the bladder 5.

Bladder 5 is made of a plastic, however not necessarily resilient, material which will collapse like a plastic bag if gas is removed from the bladder. In FIG. 1 the shape of bladder 5 is denoted as 23. Dotted line 13 indicates the size of the bladder when completely filled with gas.

If hood 1 is completely filled with gas it assumes the shape indicated by dotted line 12. If further gas is introduced into hood 1 the positive pressure created in the hood will cause gas from the hood to escape between the wearer's neck and neckband 11. If gas is withdrawn from hood 1 it will collapse and assume a shape 25 as shown in FIG. 1. Line 21 shows an example of a possible intermediate shape of the hood.

The operation of the respirator during the wearer's respiratory cycle is as follows. When the apparatus is being used the hood 1, after being put over a wearer's head, assumes a shape as indicated by 21 in FIG. 1. Valves 9 and 10 are opened to allow a continuous flow of breathing gas from container 7 to bladder 5. Upon the user's initiation of a breathing cycle a small negative pressure is created in mask 2. In response to this negative pressure, valve 4 is closed and valve 6 is opened simultaneously or preferably somewhat later when the pressure in mask 2 becomes more negative. A larger negative pressure is required to open valve 3 from its closed position than for valve 6. Consequently, bladder 5 will supply fresh breathing gas from the onset of the inhalation phase. If bladder 5 is emptied during the inhalation phase, the pressure in mask 2 will become lower and cause valve 3 to open. Thus, the last part of inhaled gas during the inhalation phase will consist of the gas being taken from the hood 1 and of gas from container 7, since valve 6 is still open and gas is continuously flowing through line 8. Because gas is taken from the hood 1, the major part of the hood will collapse further and assume a shape indicated by line 25, thus preventing the creation of negative pressure in hood 1. Since the pressure inside the hood is substantially equal to the outside pressure no leakage into the hood will occur.

Upon initiation of an expiration phase, the pressure in mask 2 will rise to a positive pressure which will cause valves 3 and 6 to close and valve 4 to open. Gas entering hood 1 through valve 4 will reshape hood 1 to a greater volume as shown for example by 21. When the maximum volume has been reached, as indicated by line 12, a positive pressure will be created in hood 1. This positive pressure will force gas to escape from the hood between the wearer's neck and neckband 11.

During this expiration phase, bladder 5 has been supplied with new breathing gas from container 7 and a new breathing cycle will commence. A portion of the exhaled gas remaining in the hood 1 will be reused during the subsequent breathing cycle. Despite this, the contents of oxygen and carbon dioxide will nevertheless be maintained at acceptable levels, the reason being that fresh breathing gas is supplied during the first stage of inhalation and thus remains in the lungs for the longest period of time. The previously used gas, which is subsequently inhaled from the hood through open valve 3 during the second stage of the breathing cycle, will remain in the lungs for a shorter time. The most recently inhaled amount of gas will not reach the lungs at all but will remain in the respiratory passages to be exhaled again.

Figure 2:
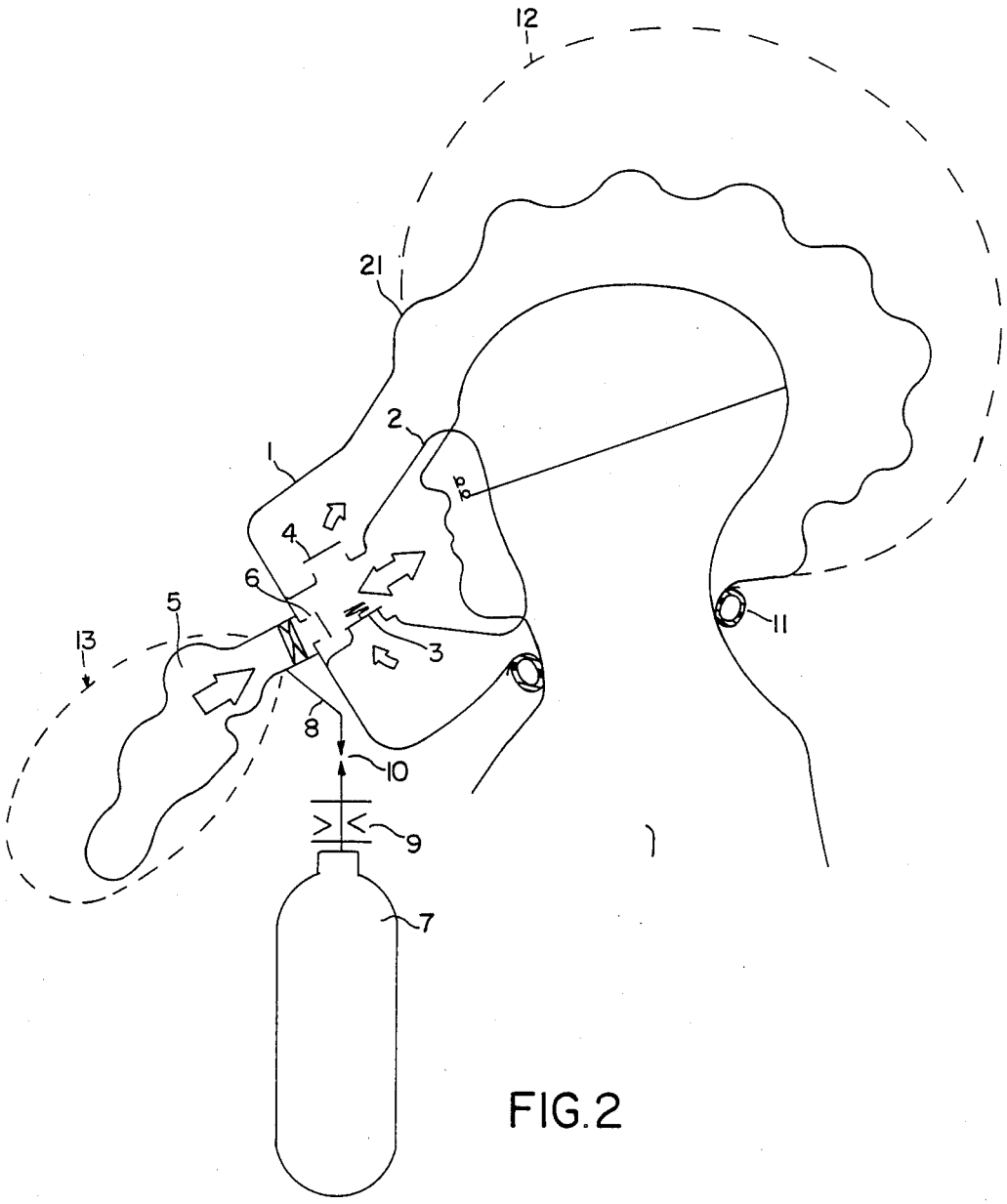
FIG. 2 shows another embodiment of the apparatus according to the present invention.

The embodiment shown in FIG. 2 differs from that in FIG. 1 in that there is a valve means 22 in bladder 5 incorporated between the connection with line 8 and valve 6. This valve means 22 will close when bladder 5 is empty and valve 3 opens. This will prevent mixing of fresh breathing gas with gas entering the mask 2 through valve 3 from the hood 1 during the last part of the inhalation phase. Such arrangement will reduce the amount of breathing gas necessary in container 7 or allow a longer use of the breathing apparatus. In this case the flow rate of gas through line 8 will be less than in the embodiment of FIG. 1. FIG. 3 illustrates the structure of a possible embodiment of valves 4 and 6 employed in the apparatus of FIG. 1 of the present application. These valves are non-return valves and are of the type known in the art.

As shown in FIG. 3A and B valve seat comprises two annular members 61 and 62, respectively. These members are arranged concentrically in the same plane and are held together by four arms 63.

As shown in FIG. 3C the valve body comprises an axis 64 having a head at each end thereof. A circular elastic membrane 65 is attached to the head on the right hand end of axis 64. The outer peripheral part of the membrane 65 is inclined towards the outer end of the axis 64. The outer diameter of the membrane 65 is greater than the inner diameter and smaller than the outer diameter of the annular member 61 as shown in FIG. 3D. The axis 64 between the two heads is approximately the same length as the annular member 62 or is slightly longer.

FIG. 4A and B shows the valve placed in a duct. On the left hand side of the valve there is a pressure P1 and on the right hand side thereof pressure P2. As illustrated in FIG. 4A P1 exceeds P2. In this case gas will flow from the left hand side to the right hand side. The pressure difference will force the membrane outer part to the right and thus gas can flow between the annular member 61 of the valve seat and the outer peripheral part of the member 65.

In FIG. 4B the pressure P2 on the right hand side exceeds the pressure P1 on the left hand side. The membrane 65 will be pressed against the valve seat and no gas can pass from the right hand side to the left hand side.

Also, as indicated in FIG. 3 the outer periphery of the membrane 65 lies against the annular member 61 when there is no pressure difference acting on the valve.

During the first part of the inhalation phase a pressure P1 on the side of the valve 6 which communicates with the bladder 5 will exceed a pressure P2 in the face mask and accordingly with a function of the valve 6 described above will open valve 6. At the same time a pressure P3 in hood 1 higher than pressure P2 in the mask 2 will close valve 4 since higher pressure P3 acts upon the opposite side of the membrane in valve 4.

FIG. 5 illustrates a possible embodiment of valve 3 of FIG. 1 of the present application. Valve 3 comprises a tubular member 40. In spaced relationship inside the tubular member 40 there are two annular members 41 and 42, respectively, which are attached to the inside wall of member 40. Member 41 has an annular shoulder 45 pointing towards member 42. Between the annular members 41 and 42 are located a disc 44 and a helical spring 43. One end of spring 43 is attached to member 42 and the other end of spring 43 is attached to disc 44 which is made of a rigid material. Disc 44 is forced against the shoulder of ring member 41 by spring 43. The pointed edge of the annular shoulder is sealingly engaged to disk 44 by the force of spring 43. The force being exerted by spring 43 is a function of the spring characteristics and the degree of compression when placed between disc 44 and member 42. Thus, the force exerted by spring 43 can be predetermined, and valve 3 can be preset to open when the pressure P2 in the mask falls lower than the value necessary for valve 6 to open.

The pressure on the right hand side communicating with mask 2 is denoted P2 and on the left hand side communicating with hood 1 is denoted P1. When $P2=P1$ the force exerted on disc 44 against the annular shoulder is F1. When $P2<P1$ the pressure difference P acts on the left side of disc 44. This pressure difference acts on a disc area A which is equal to the area of a circle having a diameter of D. Thus, the force acting on the left hand side of disc 44 is PA. When the force PA acting on the left hand side equals the force F1 exerted by spring 43 on the right hand side the valve 3 is still closed. When the force PA>F1 the disc 44 will be displaced to the right. The displacement is a function of and the spring constant k.

However, the valve 3, shown in FIG. 5 can also be used to function as valve 4 and 6. In such a case the area A is chosen greater and/or a spring having a smaller spring constant is used.

Figure 6:
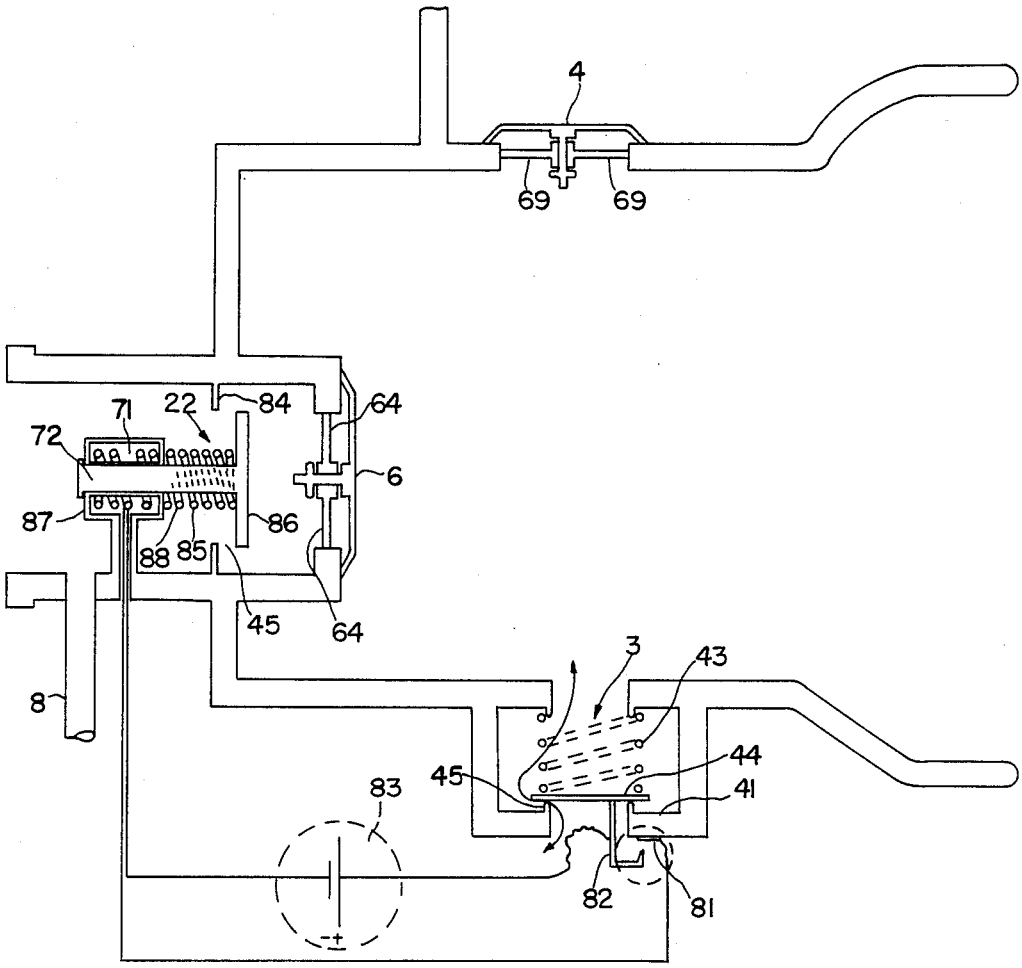
FIG. 6 shows in enlarged detail the embodiment shown in FIG. 2 with valves, 3, 4, 6 and 22.

In FIG. 6 the embodiment of FIG. 2 is shown in greater detail. Valves 4 and 6 are of the type described in connection with FIG. 3.

Valve 3 comprises a helical spring 43 and a disc 44. Disc 44 is pressed by spring 43 against shoulder 45 of annular member 41. On the side opposite shoulder 45 of annular member 41 there is an electrically conducting plate 81 which is connected through coil 71 to the negative terminal of a battery 83. One end of arm 82 is connected to disc 44 and the other end of arm 82 is placed at a small distance from plate 81 when valve 3 is closed and is brought in contact with the plate 81 when valve 3 is open. The arm 82 is connected to the positive terminal of battery 83.

Valve 22 comprises a valve seat 84 and a valve body 85 having a T-shape. The top 86 of the T is pressed against the shoulders of valve seat 84 when valve 22 is closed. The body 72 of the T is placed in a housing 87 having opposite openings through which the body 72 of the T can be displaced. Inside the housing coil 71 is wound around the body 72 of the T in spaced relationship. Between the housing 87 and the top of the T there is a helical spring 88.

When arm 82 is in contact with plate 81 the electric loop containing coil 71 is closed. In this case the body 72 of the T will force the top 86 of the T against the shoulder of the valve seat 84 against the force of the spring 88. When valve 3 is closed the one end of arm 82 will be moved away from plate 81 and thus open the electric loop. Coil 71 will stop acting on the body 72 of the T, thus the spring 88 will open valve 22.

During the operation of the respirator shown in the embodiment of FIG. 2, breathing gas is continuously flowing into the bladder. At the moment before initiation of the breathing cycle, valve 3 and valve 4 are closed. Thus the electric loop is open as well as valve 22. Upon inhalation valve 6 will be opened and breathing gas is drawn past valve 6. When the bladder has been emptied valve 3 will open and put arm 82 against plate 81 thus closing the electric loop. Coil 71 will draw body 72 of the T to the left and close valve 22. Now the supply of breathing gas in the subsequent inhalation phase will be drawn only from the hood. Upon initiation of the expiration phase valves 6 and 3 close and valve 4 opens. When valve 3 is closed arm 82 will be disconnected from plate 81, thus opening valve 22.

Figure 7:
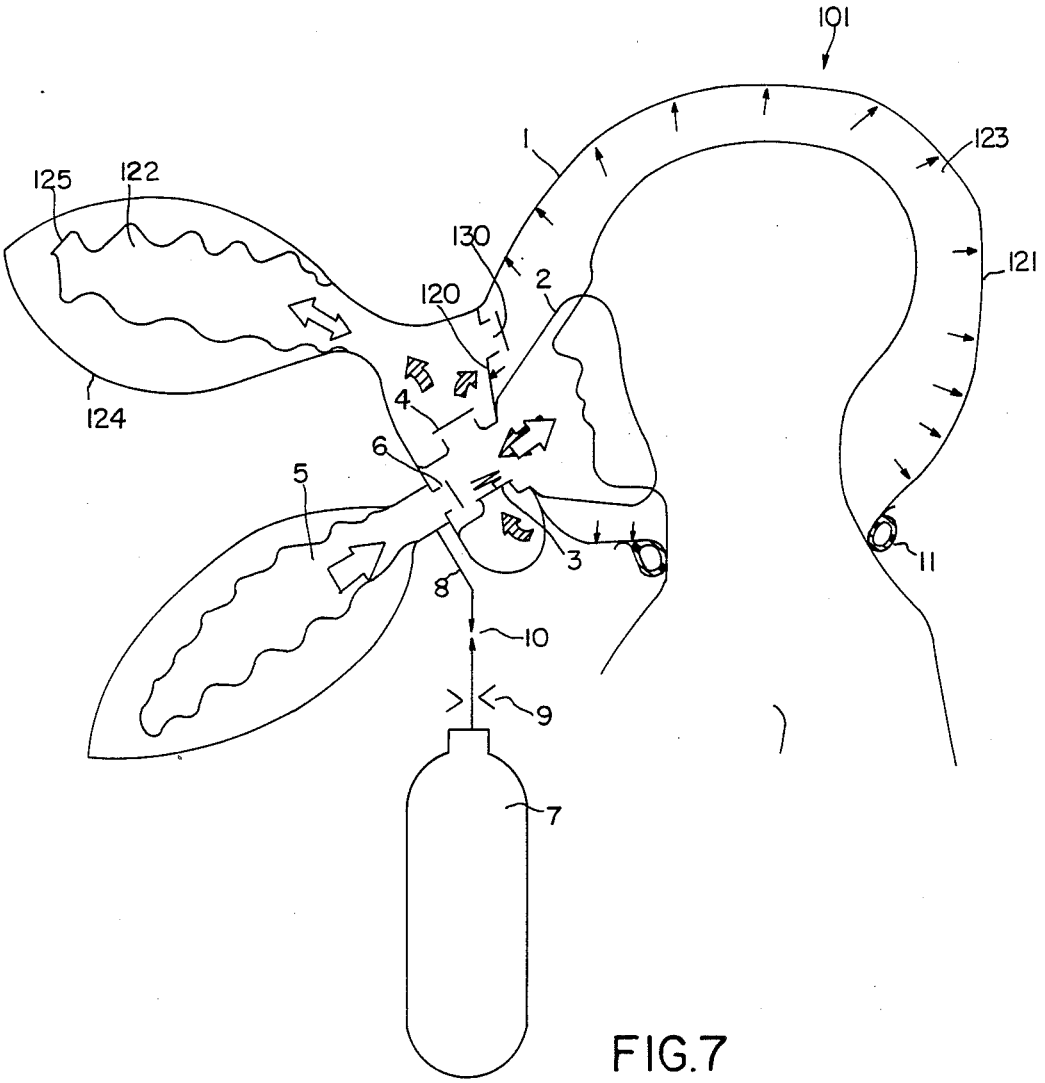
FIG. 7 shows still another embodiment of the apparatus according to the present invention.

FIG. 7 illustrates another possible embodiment of the respirator according to the present invention. The hood 101 of FIG. 7 is divided into two chambers 123 and 122 respectively. Chamber 123 surrounds the face mask 2, the user's head and neck and chamber 122 is positioned outside the chamber 123 and separated from it by a partition wall 120. The partition wall includes a second exhalation valve 130 allowing gas from chamber 122 to enter chamber 123 but not in the reverse direction. The outer wall 124 defining chamber 122 is made of a plastic, flexible, but not necessarily resilient material. Also the wall 121 defining chamber 123 is made of a flexible, but not necessarily resilient, plastic material. During the first part of the inhalation phase breathing gas is drawn from the bladder 5 and during the second part thereof gas is drawn from chamber 122 through valve 3.

At the end of the inhalation phase the wall of the chamber 122 will assume the shape indicated as 125. During the exhalation phase gas is forced through valve 4 into chamber 122 and when the pressure in chamber 122 exceeds the pressure in chamber 123 further into chamber 123 and finally gas is forced to escape between the user's neck and neckband 11 to the surroundings. In this embodiment chamber 123 is always completely filled with gas having a higher pressure than the surroundings. This will effectively prevent air leakage into the hood 101.

The chamber 122 can be positioned differently with respect to chamber 123. For example, chamber 122 can be located within chamber 123. In this design partition wall 120 incorporating a second exhalation valve 130 will coincide with wall 121 defining chamber 123.

The foregoing are but a few of the various embodiments which may be made and used in accordance with the invention. Therefore, it should be understood that the accompanying drawings and the related detailed description thereof are illustrative and are not to be construed as limiting the invention except as may be required by the following claims, construed in the light of such equivalents as may be proper in respect thereto.

We claim:

1. A rescue type breathing apparatus comprising:

a hood adapted to enclose a user's head and neck, said hood being at least substantially made of a flexible material and including an elastic neck seal means for allowing gas from the inside of said hood to escape to the outside when the pressure in said hood exceeds the ambient gas pressure and substantially preventing leakage of the ambient gas into said hood when the ambient gas pressure exceeds the pressure in said hood;

a face mask mounted inside said hood, said face mask including gas communication means for allowing passage of breathing gas between said hood and said face mask;

gas supply means connected to said face mask for supplying breathing gas to said face mask;

controlling means responsive to changes in gas pressure in said face mask during the inhalation and exhalation phase of a respiratory cycle of the user for allowing the flow of said breathing gas from said gas supply means to said mask during at least the first part of the inhalation phase in response to a first inhalation demand by the user;

said gas communication means including first and second regulating means responsive to changes in gas pressure in said face mask;

said first regulating means allowing passage of gas including said breathing gas from said face mask into said hood in response to exhalation and said second regulating means allowing passage of gas including said breathing gas from said hood into said face mask during the second part of said inhalation phase in response to subsequent inhalation demand by the user.

2. A rescue type breathing apparatus according to claim 1, wherein said controlling means comprises a first valve means located between said gas supply means and said face mask for admitting said breathing gas from said gas supply means to said face mask, said first valve means being actuated during the first part of the inhalation phase of the respiratory cycle of the user.

3. An apparatus according to claim 2, wherein said first regulating means comprises a second valve means actuated to its open position during the exhalation phase for admitting gas including said breathing gas from said face mask to said hood.

4. An apparatus according to claim 3, wherein said second regulating means comprises third valve means actuated to its open position during the second part of the inhalation phase for admitting gas including said breathing gas from said hood to said face mask.

5. An apparatus according to claim 4, wherein when said second valve means opens, during the exhalation phase, said first and third valve means remain closed.

6. An apparatus according to claim 5, further comprising fourth valve means mounted in said gas supply means upstream of said first valve means, said fourth valve means for shutting off breathing gas flow from said gas supply means through said first valve means to said mask during the second part of the inhalation phase of the user.

7. A rescue type respirator apparatus comprising:

a first, expandable, resilient hood member adapted to enclose a wearer's head, said first member including elastic neck means for sealingly engaging the hood member above the wearer's neck and allowing gas from the inside of said hood to escape to the outside when the pressure in said hood member exceeds the ambient gas pressure and substantially preventing leakage of the ambient gas into said hood member when the ambient gas pressure exceeds the pressure in said hood member, said first member forming a first chamber;

a second mask member mounted within said first chamber and configured to fit over the wearer's face, said second mask member being provided with sealing means for sealingly engaging the wearer's face, said second mask member forming a second chamber;

means for supplying breathing gas to said second chamber during the first part of the inhalation phase of the user;

means for controlling the flow of breathing gas into said second chamber;

means for permitting a flow of gas from said second chamber into said first chamber during the exhalation phase of the wearer; and means for permitting the flow of a portion of gas including said breathing gas from said first chamber into said second chamber during the second subsequent part of the inhalation phase of the wearer.

8. An apparatus according to claim 7, wherein said means for supplying the breathing gas includes a bladder or a flexible reservoir connected to said second chamber and a breathing gas container connected with said bladder or reservoir.

9. An apparatus according to claim 8, wherein said controlling means comprises first valve means located between said supply means and said second chamber for admitting the portion of breathing gas into said second chamber during the first part of the inhalation phase.

10. An apparatus according to claim 9, wherein said permitting means includes a second and third valve means, respectively, located between said first and second chambers.

11. An apparatus according to claim 10, wherein said third valve means remains closed during the first and second part of the inhalation phase and opens during the first and second part of the inhalation phase and opens during the subsequent exhalation phase for releasing exhalation gas from said second chamber to said first chamber with said first and second valve means being closed during the exhalation phase.

12. An apparatus according to claim 11, further comprising a fourth valve means located between said supply means and said first valve means for discontinuing flow of the breathing gas from said supply means through said first valve means into said second chamber during the second part of the inhalation phase of the wearer.

13. A method of supplying a breathing gas during a respiratory cycle of a person using a rescue type respirator including a sealed hood, a face mask mounted inside the hood and a breathing gas supply in communication with the face mask, said method comprising the steps of:

supplying a first portion of gas including breathing gas from said breathing gas supply to the face mask during the first part of the inhalation phase of the person; and supplying a second portion of gas including the breathing gas from the hood to the face mask during the second part of the inhalation phase of the person.

14. A method of supplying a breathing gas according to claim 13, further comprising the step of simultaneously supplying said breathing gas from said gas supply with said second portion of gas during the second part of the inhalation phase of the person.

15. A method of supplying a breathing gas during a respiratory cycle of a person using a rescue type breathing apparatus, including a sealed hood adapted to be applied over the person's head, a face mask mounted in the hood, a bladder or flexible reservoir connected with the face mask, a first gas flow controlling means located between said bladder or reservoir and said face mask and a second gas flow controlling means located between the hood and the face mask, said method including the steps of:

supplying a breathing gas during a first part of the inhalation phase of the person, said step of supplying including providing a gas container connected to the bladder or flexible reservoir;

delivering the gas from the gas container to the bladder or flexible reservoir;

actuating the first gas flow controlling means during first part of the inhalation phase to admit the gas into the face mask from the bladder or reservoir at which time the bladder is empty;

supplying breathing gas during a second part of the inhalation phase of the person by actuating the second gas flow controlling means for supplying gas from the hood into the face mask while simultaneously continuing a supply of the breathing gas from the gas container by continuing actuation of the first gas flow controlling means.

16. A method according to claim 15, wherein said first gas flow controlling means includes a first valve means actuable to open during the first part of said inhalation phase of the respiratory cycle of the person.

17. A method according to claim 16, wherein said second gas flow controlling means includes a second and third valve means, said third valve means being open and said second valve means being closed during the second part of said inhalation phase of the respiratory cycle of the person.

18. A method according to claim 17, further comprising, during the exhalation phase of the respiratory cycle, the step of actuating said second valve means of said second gas flow controlling means to open for releasing gas from said face mask to said hood during the exhalation phase, said first valve means of said first gas flow controlling means and said third valve means of said second gas flow controlling means being closed.

19. A method according to claim 18, further including a step of providing a fourth valve means located between the bladder and the first valve means for preventing a flow of breathing gas from the bladder or reservoir and container and actuating said fourth valve means during the second part of the inhalation phase of the person.

* * * * *